US008104133B2

(12) United States Patent
Paterson

(10) Patent No.: US 8,104,133 B2
(45) Date of Patent: Jan. 31, 2012

(54) GUTTER CLEANING APPARATUS

(76) Inventor: Michael Stephen Paterson, Salisbury Downs (AU)

( * ) Notice: Subject to any disclaimer, the term of this patent is extended or adjusted under 35 U.S.C. 154(b) by 447 days.

(21) Appl. No.: 11/988,128

(22) PCT Filed: Jun. 21, 2006

(86) PCT No.: PCT/AU2006/000872

§ 371 (c)(1),
(2), (4) Date: Jun. 23, 2009

(87) PCT Pub. No.: WO2007/002983

PCT Pub. Date: Jan. 11, 2007

(65) Prior Publication Data

US 2009/0293217 A1 Dec. 3, 2009

(30) Foreign Application Priority Data

Jul. 1, 2005 (AU) ..... 2005903479

(51) Int. Cl.
*E04D 13/076* (2006.01)

(52) U.S. Cl. ..... 15/236.04; 15/236.01; 15/236.07; 15/236.09; 30/169; 30/171; 294/176; D32/49

(58) Field of Classification Search ..... 15/236.01, 15/236.04, 236.05–236.09; 30/169, 171; 294/176, 181; D32/46–49
See application file for complete search history.

(56) References Cited

U.S. PATENT DOCUMENTS

| | | | | | |
|---|---|---|---|---|---|
| 2,299,418 | A | | 10/1942 | Thomas | |
| 3,858,267 | A | * | 1/1975 | Swannie | 15/236.04 |
| 4,194,780 | A | | 3/1980 | Dilley | |
| D267,357 | S | * | 12/1982 | Hillstrom | D32/46 |
| 4,542,553 | A | | 9/1985 | Cary | |
| 4,640,540 | A | * | 2/1987 | Chisholm | 294/180 |
| 4,848,818 | A | | 7/1989 | Smith | |
| 5,988,715 | A | | 11/1999 | Mason | |
| 6,257,256 | B1 | | 7/2001 | Fischer | |
| 6,842,937 | B2 | * | 1/2005 | Li | 15/236.04 |
| 2003/0051305 | A1 | | 3/2003 | Hewlett | |

FOREIGN PATENT DOCUMENTS

| | | | |
|---|---|---|---|
| GB | 2286112 | * | 8/1995 |
| GB | 2370755 | | 7/2002 |
| GB | 2404847 | | 2/2005 |

* cited by examiner

*Primary Examiner* — Mark Spisich
(74) *Attorney, Agent, or Firm* — Renner, Kenner, Greive, Bobak, Taylor & Weber

(57) ABSTRACT

An apparatus for removing accumulated leaves and other debris from an overhead gutter of a building or the like, said apparatus including a blade adapted to skim a substantial portion of the internal skirt of said gutter to which leaves and debris are accumulated therein, and an elongated handle having one end adapted to be held by a user at a remote end substantially perpendicular to said blade.

10 Claims, 7 Drawing Sheets

GUTTER CLEANING APPARATUS

TECHNOLOGICAL FIELD

This invention relates to an apparatus for removing accumulated leaves or other debris from an overhead gutter of a. building or the like, and more particularly to an improved hand-held apparatus or tool conveniently used by a user to efficiently clean leaves and other debris from overhead gutters of a home or similar such premises.

BACKGROUND ART

It is well known to any maintenance minded person, that the overhead gutters of a building, whether it be ones at home, place of work or factory, must be periodically cleaned in order to prevent such gutters from becoming clogged with leaves and other debris which is collected therein.

As is to be expected if one ignores proper maintenance and cleaning of gutters this leaves the problem of ultimate improper water-flow to the ground from the roof of the building during rainfall.

Instead of having the rainwater appropriately directed from the roof of the building, through the overhead guttering and into the down-pipe for washing away through storm water drains, once leaves and other debris have clogged up the overhead guttering, such water is not directed through the drainage system but alternatively spills out in all directions cascading down onto ground surfaces, often not designed to accept the flow of water, which could lead to such flows heading back into the building, leading to rising damp and other such structural problems to the building.

Still further, failure to properly clean gutters also inevitably results in accelerated deterioration of the gutters and eaves as the rotting material accelerates the corrosion of the material making up the guttering.

Traditionally, the maintenance minded person when going about cleaning gutters, climbs upon a ladder and removes the leaves and debris by hand. Sometimes gloves or even scraping devices, such as one with a handle where longitudinally extending there from is a blade, the kind one associates with scraping paint from a wall of the like.

Nonetheless it is quite incidental whether or not gloves or these traditional scraping blades are used because in any event such methods to clean the overhead gutters requires either an individual perform the dangerous task of crawling around the perimeter of the house cleaning the entire gutter system, or perhaps even worse, continually returning to the ground and shifting a ladder laterally three to four feet and then again climbing the ladder to remove the debris from the gutter, because three to four feet is about the maximum span an outstretched hand has to grasp at leaves and debris contained within the guttering.

Not only is such techniques for cleaning the overhead guttering potentially dangerous to the maintenance minded person, it is also particularly laborious and time consuming.

In an effort to render gutter cleaning a less undesirable maintenance chore, various alternatives have been presented in the past to try and overcome the problem of overhead gutter cleaning through the use of ones hand or a very basic scraper, once again where such scrapers are characterized by a short stump handle grasped in the palm of the user and then a blade longitudinally extending from such stump.

One such common method has been the introduction of a rain gutter cleaner which includes an attachment to secure a cleaning device to a source of fluid under pressure such as a garden hose.

As the person skilled in the art and is familiar with cleaning gutters would be familiar with, this device includes discharge orifices that directs streams of fluid along the length of the gutter to clean the debris from the gutter surfaces.

Nonetheless techniques for cleaning overhead gutters of a building or the like, utilizing pressurized fluid, such as water directed along the length of the guttering to wash away accumulated debris has a particular disadvantage of inappropriate use of a scarce resource such as water.

A further problem with such an arrangement is that as one would expect, once the leaves and the debris have hardened, generally by being baked in sunshine after rain, to dislodge such debris, significant amounts of pressure would need to be applied to have a material such as water to be able to dislodge the leaves and the like from the guttering.

Still further, the utilization of pressurized fluid has a major problem of blocking one part of the guttering, then leading to further blockages in the down pipe. As the debris and the leaves become intertwined with the pressurized fluid flow, if there is no filtering or the like taking place at the down pipe, the same leaves and debris have the potential to accumulate within the down pipe causing blockages and disruption in that part of the overall rainwater drainage system.

Therefore there still remains in the technology associated with the cleaning of overhead gutters for buildings and the like for a tool, device or apparatus that is able to improve upon these aforelisted means of cleaning or removing leaves and debris from such gutters.

Therefore, it is an object of this invention to provide an apparatus for removing accumulated leaves and other debris from an overhead gutter of a building or the like, that would be easy to use, less laborious and will not waste unnecessary water resources.

The further object of the invention is to overcome or at least substantially ameliorate some of the disadvantages and shortcomings of conventional gutter cleaning devices and methods referred to above and currently existing, or at least provide the purchasing public with a useful alternative to such conventional means and apparatus for cleaning overhead gutters that are presently available on the market.

The secondary objects and the advantages of the invention will become apparent from a full reading of this broadly described invention.

SUMMARY OF INVENTION

Accordingly there is provided an apparatus for removing accumulated leaves and other debris from an overhead gutter of a building or the like, said apparatus including, a blade adapted to skim a substantial portion of the internal skirt of said gutter to which leaves and debris are accumulated therein, and an elongated handle having one end adapted to be held by a user and a remote end substantially perpendicular to said blade.

An advantage of such an arrangement is that the person responsible for cleaning the gutter no longer needs to use their hand or the like for scraping debris free from the gutter. Although scraping devices have been used previously, an advantage of the cleaning apparatus in this invention is that the handle and the blade are substantially perpendicular with respect to the other.

Advantageously by aligning the handles substantially perpendicular to the blade, provides for a greater hand span between cleaning length wide sections of the guttering.

A further advantage by having the handle perpendicular to the scraping blade to dislodge the debris, is that the cleaning action of the hand is more of a sweeping collection type movement. That means the movement of the blade runs in parallel with the lengthwise direction of the gutter.

Conventional scrapers, of the kind referred to above that have a small wooden stump or the like grasped in the palm of the hand of the user and a blade longitudinally extending thereon, in order to dislodge debris would be scraped across the width or the breadth of the gutter.

A disadvantage of such a conventional scraper or even the use of the hand, is that rather than sweeping up or slidably dislodging the debris into one accumulated mass along the length, or at least part of the length thereof the gutter, is that there will be continual periodic mounds of debris.

The conventional use of the hand or previously available scrapers was designed simply to move a lengthwise distance of the gutter in segments either scraping the debris from the gutter to the ground or placing piles of such debris along the roof, for removal at the completion of the cleaning.

Advantageously with this invention the elongated handle perpendicular to the blade provides for the sweeping action, which draws the debris along the lengthwise distance of the gutter sweeping it into a pile or an accumulated mass for easy removal there from.

A further advantage of this invention is by being able to extend the span of the lengthwise cleaning of the overhead guttering to the movement of the ladder from the ground surface below, reduces the time and laborious effort that is involved in cleaning the entire gutter system.

A further advantage of this invention, is that it provides a simple to use tooling apparatus that is not dependent on pressurized fluid or the like to dislodge the debris, and hence is environmentally friendly as it doesn't need to utilize the precious resource of water to clean the gutter system.

Still further as the handle remains substantially perpendicular to the blade the actual hand movement action for cleaning, creating the sweeping action provides for a smooth sweeping action with a greater leverage of strength which will assist in dislodging debris which is stuck hard to the internal skirting of the guttering.

In preference the handle is adapted to be grasped by a user along varying lengths of said handle.

In preference the handle telescopically encloses portions which can be extended out, according to the amount of length required to be cleaned along the guttering.

An advantage of such arrangements is that by the adjustability of the length of the handle, either by telescopically expanding or retracting the handle, or simply grasping the handle at different segments along said handle, provides for a means to extend that spanned area of cleaning per movement of the ladder below, giving the user access to the overhead guttering of the building or the like.

As the person skilled in the art will appreciate, that distance lengthwise along the gutter using simply the hand span would be at best three to four feet. Nonetheless with this invention the ability to be able to extend the length of the handle telescopically, or alternatively grasp segments of the handle at different locations, provides for a means in which a greater spanning of cleaning can be completed for one movement of the ladder which is secured to the ground below and providing access for the use to clean the overhead guttering.

As the person skilled in the art will appreciate the less time one needs going up and down the ladder and the movement thereon, will provide for a less laborious and time consuming chore of cleaning the guttering system.

In preference the handle is divided into sections of which are separated by a fold.

In this form of the invention the handle extending substantially perpendicular from the blade includes a fold to raise one portion of the handle at a higher elevation to the other when in use in the gutter.

An advantage of such an arrangement is that the blade portion of the cleaning apparatus would be able to skim the internal skirt of the guttering neatly along the edges, but at the same time the users hand, by virtual of the fold elevating part of the handle, will be kept away from contact with the guttering and any obstructions, features or otherwise of the guttering to which a hand may butt up against.

In preference the blade adapted to be slipped along and skim the internal skirt of the guttering, includes both front and rear faces adapted for such a task.

An advantage of such an arrangement is that the handle to be vastly substantially perpendicular to the blade, can be done so from either direction.

Advantageously users of this apparatus whether left handed or right, can align the blade to that surface which is most suitable for their safe usage.

Still further, as the person skilled in the art will appreciate when one gets to the corner or L-section of the guttering, it is not always that easy to use the preferred hand for the sweeping action, if safe footing is to be maintained on the ladder.

Hence there is often the requirement of the user to utilize their non-preferred hand. However the use of the non-preferred hand by the user can then be assisted by simply rearranging the handle with respect to the face of the blade, providing for either a sweeping action which will pull the debris towards the user or alternatively a pushing type action, with a push and type sweep of the debris away from the user.

Nonetheless under either arrangement rather than simply scraping or removing separate piles of debris, we are able to sweep such debris into an accumulated heap or pile.

In preference the blade defines a peripheral edge which defines a shape of a corresponding design of a gutter.

An advantage to such an arrangement is that by shaping the blade to a particular design, it can be utilized with different gutter styles. For example, if the gutter is tetragonal, or square in appearance, the blade can take on the appearance of a similar such design.

Still further, if the guttering is characterized by a half round or smooth line of appearance the blade can have its edges defined so as to provide this kind of appearance.

The matching-up of the shape of the blade to the design of the internal skirt of the guttering, will provide for a greater snug-type fit for the edge of the blade as it moves along the length of the gutter.

In preference the apparatus is made from hard durable plastic.

An advantage to such an arrangement is that by being made of such material it will be less likely to undergo gross attack as one would expect from more traditional metal-type based materials.

In preference the apparatus can be assembled, whereby the handle and the blade are stored separately, and then when in use the handle is connected to the blade or alternatively both the blade and the handle can be intricle, much like the appearance one would expect from a golf club having the head of the club rotating 90 degrees.

In preference the blade includes a protruding tab on its upper edge, said tab including an aperture or the like to which the handle could be inserted there into.

An advantage of such an arrangement is that when the blade is sweeping along the gutter, debris and the like which is accumulating during the cleaning is kept away from the handle as said handle is now secured slightly, or at least to some extent above that part of the blade which is dislodging the debris.

BRIEF DESCRIPTION OF DRAWINGS

To assist in describing the preferred embodiment of this invention, an example will now be illustrated by way of the following text and accompanying drawings wherein.

DETAILED DESCRIPTION

Figure 1:
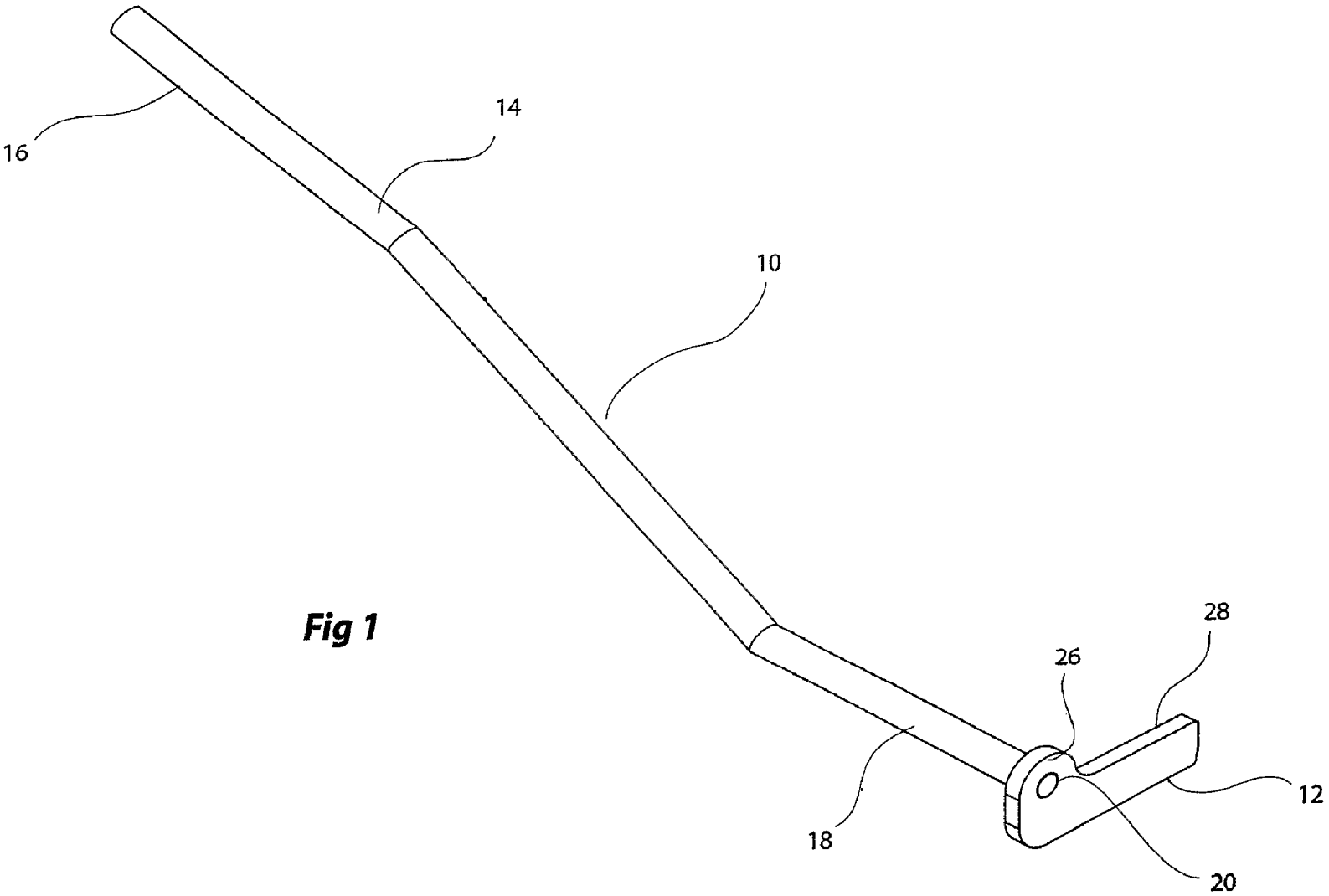
FIG. 1 is a perspective view of the gutter cleaner apparatus in the preferred embodiment of the invention.

Referring to the drawings now in detail.

A gutter cleaner apparatus 10 includes a blade 12 and a handle 14. Handle 14 at one end 16 is adapted to be grasped by the hand of a user while that the opposed remote end 18 of the handle 14, threads 20 are matched with threads 22 defined within an orifice 24 positioned on an upwardly extending tab 26 from the upper edge perimeter 28 of blade 12.

Figure 2:
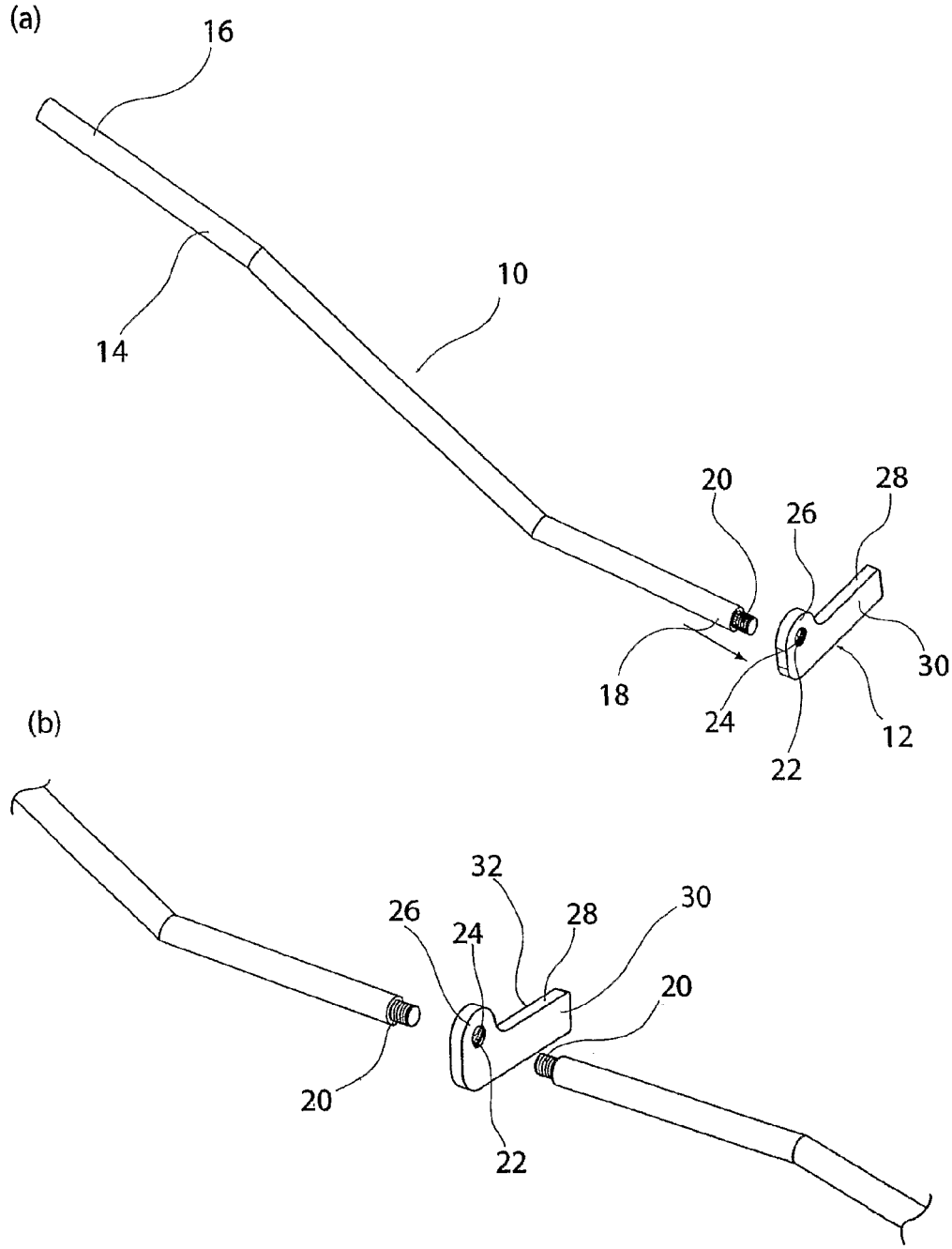
FIG. 2*a* and FIG. 2*b* show the blade and the handle unassembled, and then the ability to be assembled from either side of the scraping blade.

As best seen in FIGS. 1 and 2*b*, the handle 14 can be threaded and inserted into the blade 12 by the mated threading arrangement between 20 and 22 of the respective handle 14 and blade 12.

The fastening of the handle 14 to the blade 12 is such that the upwardly extending tab 26 keeps the handle 14 away from symmetrically opposed eternal surfaces 30 and 32, where such surfaces 30 and 32 are responsible for engaging and dislodging the leaves, debris or the like as it is swept along the length of the gutter.

By having a handle 14 fastened to the blade 12 above those surfaces, 30 and 32 responsible for dislodging debris, means that the handle 14 doesn't become clogged, dirty or the like during a sweeping action along the guttering during leaning.

As best seen in FIG. 2*b* the handle 14 can be fastened to the blade 12 from either side 30 and 32 of blade 12. The ability of being able to fasten the handle 14 to the blade 12 from either side means that the cleaning apparatus is . conveniently used by either preferred left or right hands.

FIGS. 3*a* to 3*d* show a variety of schematic representations of the blade 12, where the blade's characteristic shape has at its peripheral edges redefined so it corresponds with the style of the guttering to which is used for cleaning.

Figure 3:
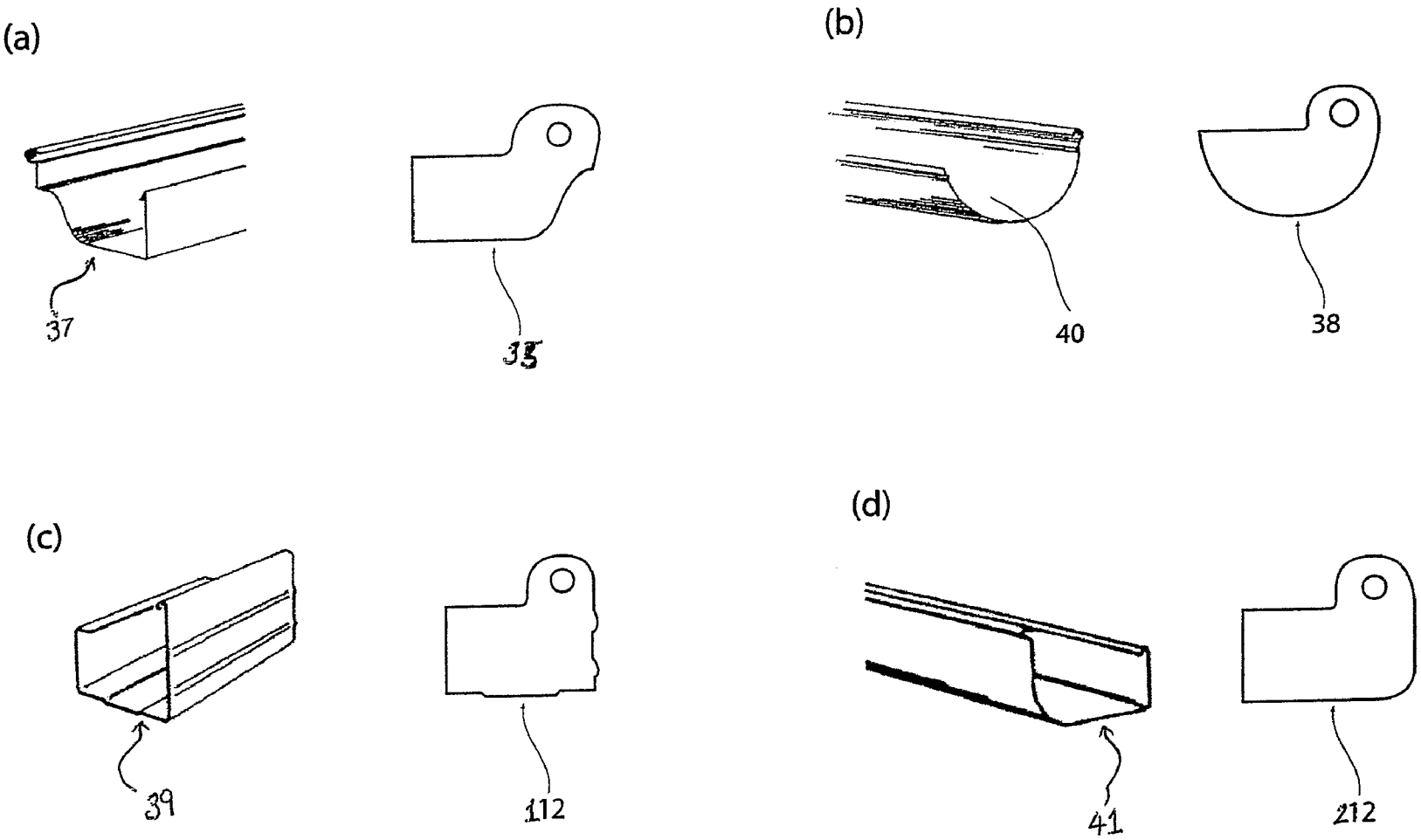
FIGS. 3*a* to 3*d*, show varying different preferred embodiments of the blade, where the blade peripheral edges define a shape of similar style to a corresponding gutter.

For example as seen in FIG. 3*b* the blade 38 takes on the shape of a half circular as this defines the style of the guttering to be cleaned as shown in FIG. 3*b* at 40. FIG. 3*a* show the blade 35 matching the gutter 37. FIG. 3*c* shows the blade 112 and the gutter 39. FIG. 3*d* shows the gutter 41 and the blade 212.

Figure 4:
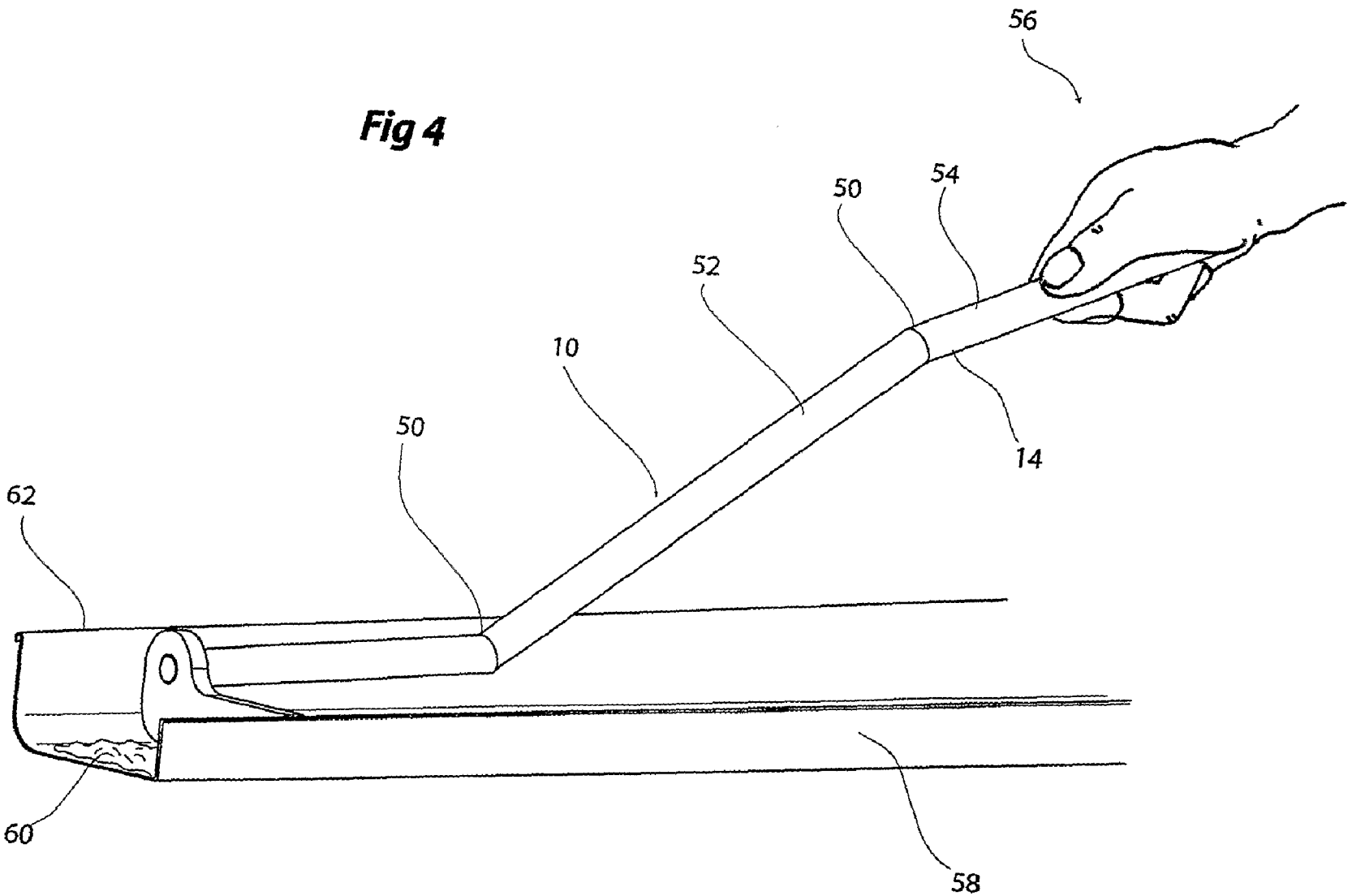
FIG. 4 shows the handle in use in the gutter.

As best seen in FIGS. 1 and 4, the handle includes folds 50 which divides the handle 14 up into segments 52 and 54. Segment 54 enables the users hand 56 to be positioned above the guttering 58. Consequently during the sweeping action of the cleaning apparatus 10 along the guttering 58, the users hand 56 is kept away from the debris 60 as well as other structural features 62 appearing along the length of the gutter 58.

Figure 5:
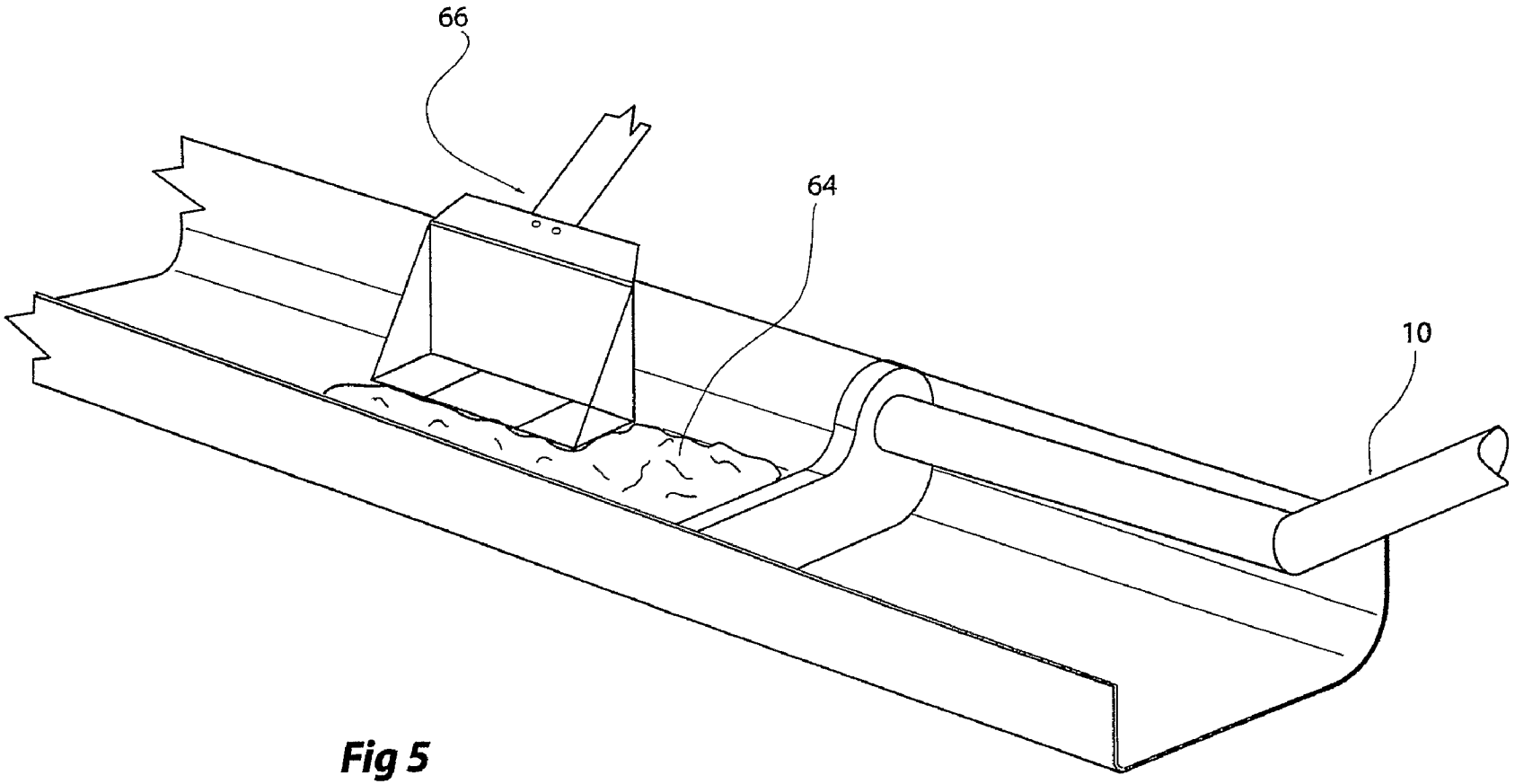
FIG. 5 shows a schematic view of the handle in use having swept up an accumulated pile of debris, leaves or the like, and is then scooped away with a shovel type apparatus.

As shown schematically in FIG. 5 once the debris 64 is being accumulated into a pile or heap by the action of the apparatus sweeping length wise across guttering 58, a shovel 66 can then be used to simply collect all the accumulated debris 64 for complete removal of the material from the guttering system.

Figure 6:
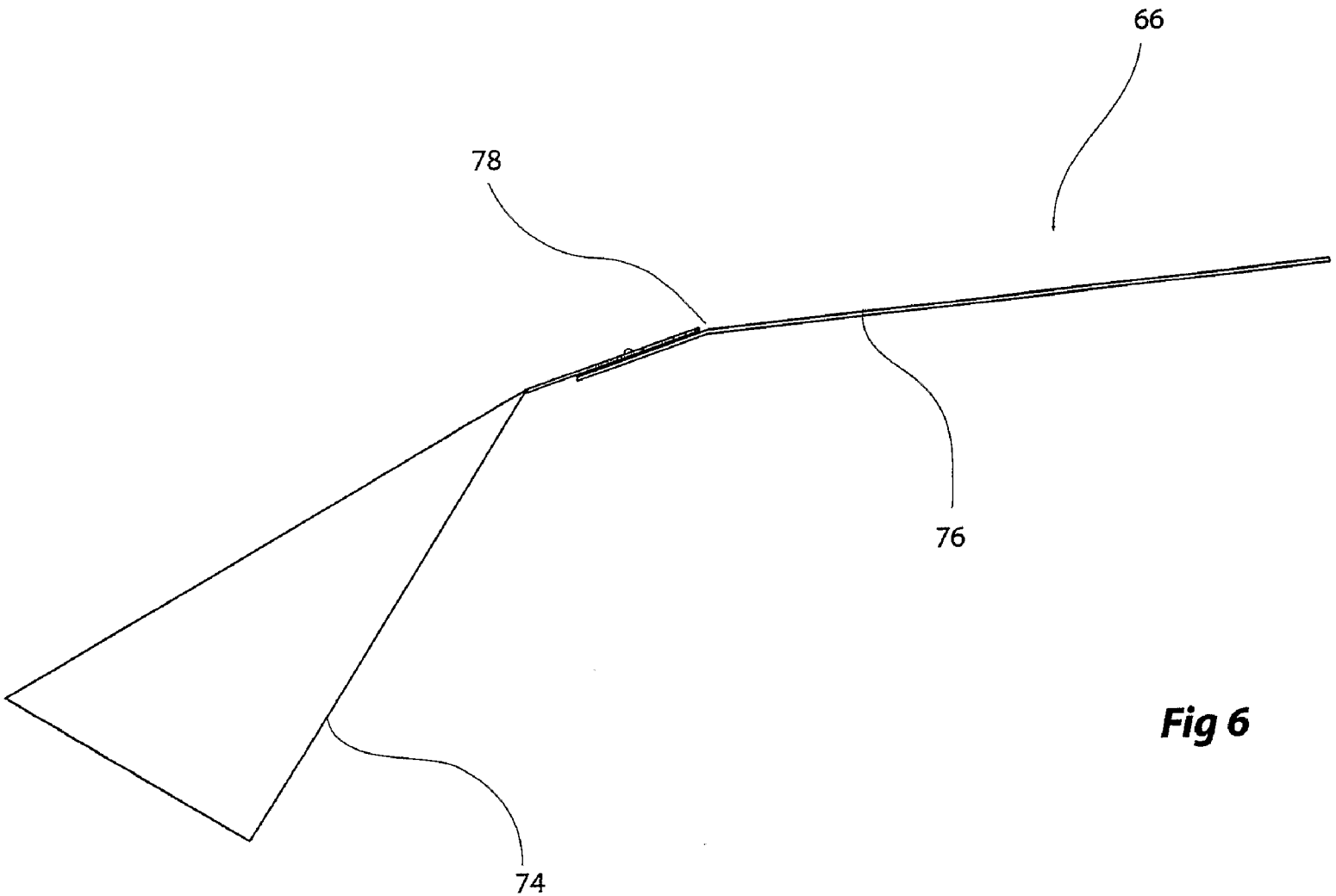
FIG. 6 shows a schematic side view of the shovel shown in FIG. 5.

As detailed in FIG. 6 there is shown a schematic side view of the shovel 66 shown in FIG. 5. The shovel includes a handle 76, fold 78 and trough 74. The fold 78 as well as the shape of the trough 74 allows the shovel 66 to be aligned and scooped across the gutter to collect the pile of debris provided for by the blade.

Figure 7:
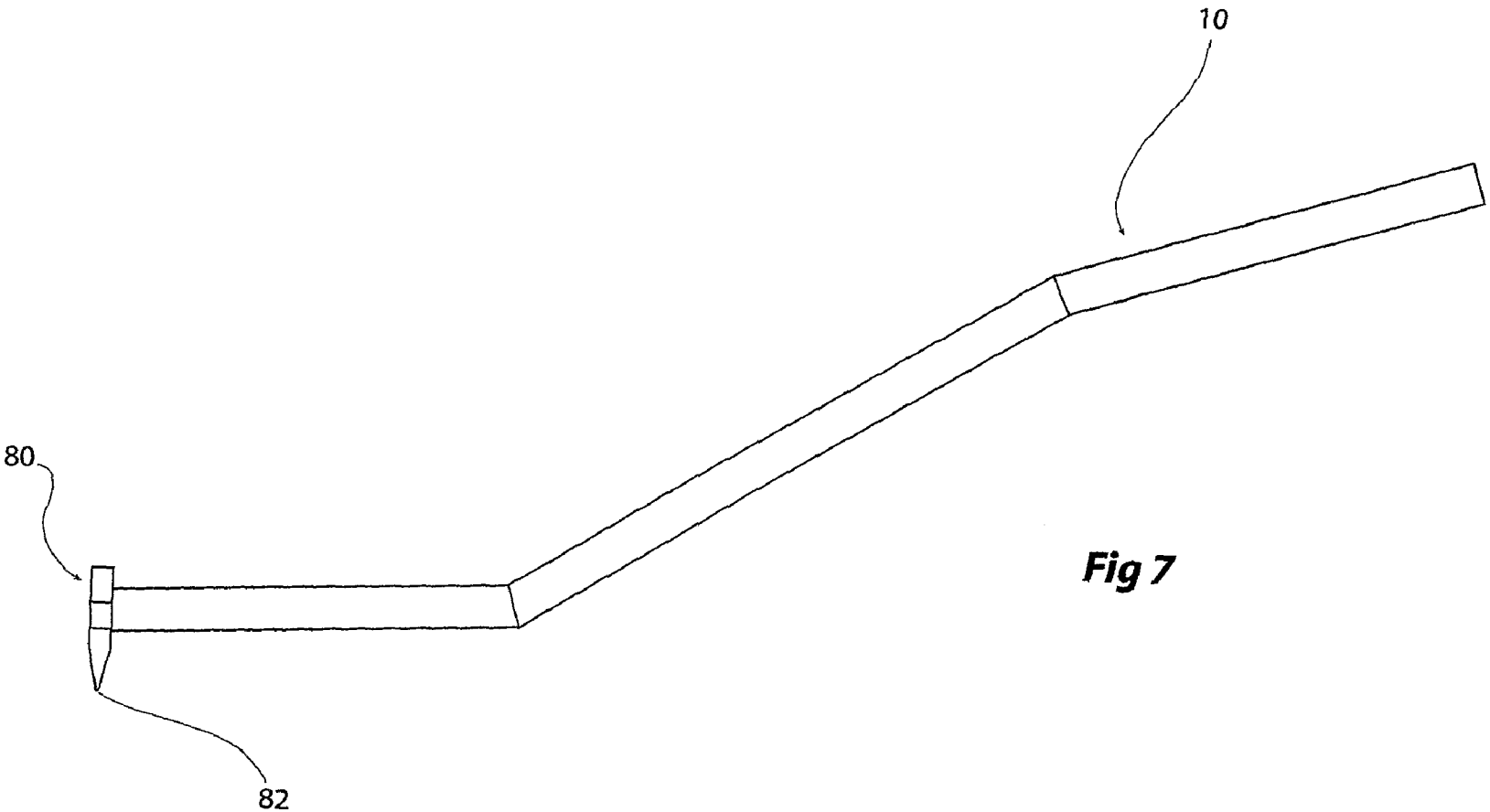
FIG. 7 shows a side view of one preferred form of the invention where the blade includes a bottom edge, tapered to create a continuous tip or sharper edge along said bottom edge.

FIG. 7 shows a side view of one preferred form of the invention where the blade 80 includes a bottom edge 82, tapered to create a continuous tip or sharper edge along said bottom edge 82. With the sharper bottom edge 82, this provides greater ability to scrap or dislodge debris that has dried or become stuck to the surface of the gutter.

It is to be appreciated by a person skilled in the art the numerous variations and/or modifications may be made to this apparatus for cleaning overhead guttering as shown in the preferred embodiments above without departing from the scope or spirit of the invention as currently described herein.

The present embodiments are therefore to be considered in all respects as illustrative and not restrictive of this invention.

The invention claimed is:

1. An apparatus for removing accumulated leaves and other debris from an overhead gutter of a building or the like, said apparatus including, a blade adapted to skim a substantial portion of the internal skirt of said gutter to which leaves and debris are accumulated therein, an elongated handle having one end adapted to be held by a user at a remote end substantially perpendicular to said blade wherein the handle is adapted to be grasped by a user along varying lengths of said handle, the blade includes a protruding tab at a corner of the upper edge, said tab including an aperture or the like to which the handle could be inserted there into such that the handle is kept away from peripheral surfaces of the blade, where such surfaces are responsible for engaging and dislodging the leaves and debris as the apparatus is pulled along a length of the gutter.

2. The apparatus of claim 1 wherein the handle extending substantially perpendicular from the blade includes a fold to raise one portion of the handle at a higher elevation to the other when in use in the gutter.

3. The apparatus of claim 2 wherein the blade is adapted to be pushed or pulled along the internal skirt of the guttering such that both front and rear faces of the blade are adapted for such a task.

4. The apparatus of claim 3 wherein the blade defines a peripheral edge which defines a shape of a corresponding design of a gutter.

5. The apparatus of claim 4 wherein it is made from hard durable plastic.

6. The apparatus of claim 5 wherein the handle telescopically encloses portions which can be extended out, according to the amount of length required to be cleaned along the guttering.

7. The apparatus of claim 6 wherein the handle and the blade are stored separately, and then when in use the handle is connected to the blade.

8. The apparatus of claim 7 wherein the handle is threaded and inserted into the blade by a mated threading arrangement between the respective handle and blade.

9. The apparatus of claim 8 further including a shovel wherein the shovel includes a handle, fold and trough wherein the shape of the trough allows the shovel to be aligned and scooped across the gutter to collect a pile of debris provided for by pushing or pulling of the blade.

10. The apparatus of claim 9 wherein the blade includes a bottom edge, said edge tapered to create a continuous tip or sharper edge along said bottom edge such that the sharper bottom edge provides greater ability to scrap or dislodge debris that has dried or become stuck to the surface of the gutter.

* * * * *